US006520090B2

(12) United States Patent
Hudson

(10) Patent No.: US 6,520,090 B2
(45) Date of Patent: Feb. 18, 2003

(54) OVERHEAD RAIL SYSTEM INCLUDING A U-BRACKET AND AN END STOP

(76) Inventor: Stanley D. Hudson, 450 E. 540th, Pittsburg, KS (US) 66762

( * ) Notice: Subject to any disclaimer, the term of this patent is extended or adjusted under 35 U.S.C. 154(b) by 0 days.

(21) Appl. No.: 09/841,533

(22) Filed: Apr. 24, 2001

(65) Prior Publication Data

US 2002/0152921 A1 Oct. 24, 2002

(51) Int. Cl.[7] ..... B61B 3/00
(52) U.S. Cl. ..... 104/95
(58) Field of Search ..... 104/249, 250, 104/251, 257, 93, 95, 89, 111

(56) References Cited

U.S. PATENT DOCUMENTS

| | | | | |
|---|---|---|---|---|
| 1,254,683 A | * | 1/1918 | Grapevine | 104/249 |
| 3,055,311 A | * | 11/1962 | Sgriccia | 104/249 |
| 3,795,199 A | | 3/1974 | Herzog | 104/100 |
| 3,900,108 A | | 8/1975 | Rotterman et al. | 211/46 |
| 4,014,269 A | | 3/1977 | Bedford | 104/250 |
| 4,453,469 A | | 6/1984 | Bedford | 104/100 |
| 4,592,527 A | | 6/1986 | Karapita | 248/318 |
| 4,603,515 A | | 8/1986 | Gilmore et al. | 51/424 |
| 4,694,531 A | | 9/1987 | Foy | 16/87.4 R |
| 4,756,401 A | | 7/1988 | Kempton | 198/468.6 |
| 5,119,732 A | | 6/1992 | Lisy | 104/48 |
| 5,355,805 A | | 10/1994 | Haab et al. | 104/106 |
| 5,402,979 A | | 4/1995 | Bellamy | 248/318 |
| 5,404,675 A | | 4/1995 | Schmidhauser | 49/409 |
| 5,419,260 A | | 5/1995 | Hamilton | 104/89 |
| 5,724,801 A | | 3/1998 | Kosigo et al. | 57/281 |
| 5,839,371 A | | 11/1998 | Knuttel | 104/172.4 |

* cited by examiner

*Primary Examiner*—S. Joseph Morano
*Assistant Examiner*—Robert J. McCarry, Jr.
(74) *Attorney, Agent, or Firm*—Martin & Associates, L.L.C.; Derek P. Martin

(57) ABSTRACT

A safety rail system includes a U-bracket for attaching a safety rail to an existing structural member, and an end stop that allows trolleys to be placed on a rail with one hand and removed with two hands, without any removal of bolts and without using any tools. The end stop is in a first position by the force of gravity that prevents a trolley from coming off the end of the rail. When a trolley is to be placed on the rail or removed from the rail, the end stop is pivoted upwards to allow wheels of the trolley to pass below the end stop. The end stop then returns to its normal, lower position, which prevents a trolley from accidentally coming off the end of the rail.

13 Claims, 3 Drawing Sheets

OVERHEAD RAIL SYSTEM INCLUDING A U-BRACKET AND AN END STOP

BACKGROUND OF THE INVENTION

1. Technical Field

This invention generally relates to material handling systems, and more specifically relates to an overhead rail system.

2. Background Art

Overhead rail systems have become common in warehouse environments that require efficient movement of items that have considerable weight. Recently, overhead rail systems have been developed that can service multiple levels in a warehouse. As personnel began working around these rail systems that can service multiple levels, the risk from falling was recognized. As a result, safety rail systems were developed to provide a greater measure of safety to the warehouse worker. A safety rail system typically has rails that are placed perpendicular to the main overhead rail system so a person can move laterally with respect to the main overhead rail. A safety rail system typically includes rails of an I-beam or similar structure, and a trolley that rolls along the rails. The trolley typically includes an eyelet into which a hook may be attached. A worker wears a harness with a safety line that is terminated with a hook that may be attached to the eyelet on the trolley. Thus, when a worker reports to work, the worker puts on the harness, and clips the hook of the safety line coupled to the harness onto the trolley. The worker is then free to move in directions lateral to the main overhead rail to load and unload inventory to/from the main overhead rail. The safety line prevents the worker from falling to the ground if the worker slips and falls from an upper level in the warehouse, thereby preventing possible serious injury. Instead of striking the ground, the safety line will halt the descent of the falling worker, supporting the worker and avoiding contact with the lower level floor.

In the frozen food industry, overhead rail systems are often used to transport frozen food within a warehouse. Safety rail systems have been employed to avoid injury to workers in a frozen area. Sometimes a trolley needs to be added or removed from the safety rail system. For example, if an experienced employee is training a new employee, there may be a need for two safety trolleys on the safety rail system rather than just one. Known safety rail systems include end stops that are bolted onto the rail. Thus, if a new trolley needs to be added, bolts are loosened, then removed, the end stop is then removed, the new trolley can be placed on the rail, the end stop is then replaced, and the bolts are replaced and tightened into place. In some environments, performing these multiple operations may prove to be a nuisance that wastes time. In a frozen food environment, however, these detailed operations are much more difficult because they are either performed with gloved hands, which is difficult, or are performed using bare hands in freezing temperatures. Neither is a good solution. Without a rail system that allows trolleys to be placed onto the rail system and taken off the rail system without disassembling any portion of the safety rail system, the frozen food warehousing industry will continue to be plagued by inefficient mechanisms and methods for adding and removing trolleys from the safety rail system.

DISCLOSURE OF INVENTION

According to the present invention, a safety rail system includes a U-bracket for attaching a safety rail to an existing structural member, and an end stop that allows trolleys to be placed on a rail with one hand and removed with two hands, without any removal of bolts and without using any tools. The end stop is in a first position by the force of gravity that prevents a trolley from coming off the end of the rail. When a trolley is to be placed on the rail or removed from the rail, the end stop is pivoted upwards to allow wheels of the trolley to pass below the end stop. The end stop then returns to its normal, lower position, which prevents a trolley from accidentally coming off the end of the rail.

The foregoing and other features and advantages of the invention will be apparent from the following more particular description of preferred embodiments of the invention, as illustrated in the accompanying drawings.

BRIEF DESCRIPTION OF DRAWINGS

The preferred embodiments of the present invention will hereinafter be described in conjunction with the appended drawings, where like designations denote like elements, and.

BEST MODE FOR CARRYING OUT THE INVENTION

The present invention overcomes limitations of known overhead rail systems by providing an end stop that allows a trolley to be easily placed on a rail and taken off a rail, while providing absolute safety against the trolley unintentionally rolling off the rail. The overhead rail system of the present invention also includes a U-bracket that allows hanging a rail from existing rails and structural members.

Figure 1:
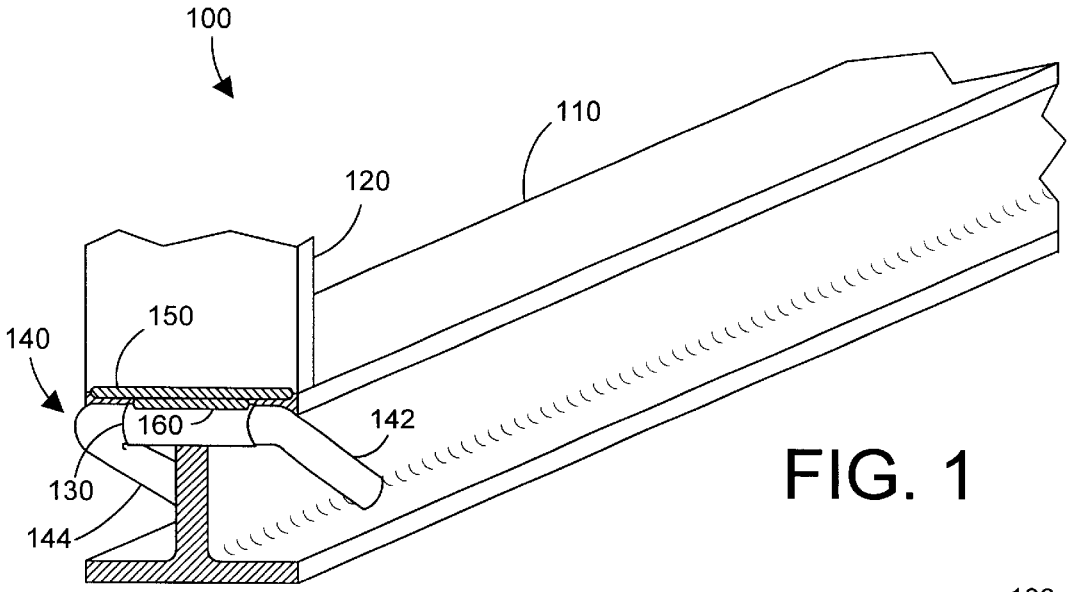
FIG. 1 is perspective view of an overhead rail system that includes an end stop in accordance with the preferred embodiments.
Figure 2:
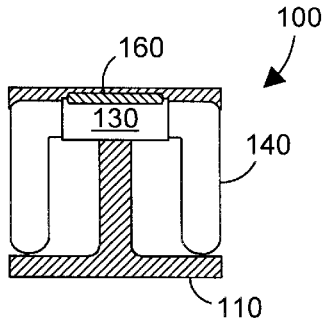
FIG. 2 is an end view of the overhead rail system in FIG. 1.

Referring to FIGS. 1 and 2, an overhead rail system 100 includes a rail 110 supported by a support 120. In the preferred embodiments, rail 110 is an I-beam, and is attached to support 120 via a weld 150 that joins rail 110 to support 120 (FIG. 1). Note, however, that rail 110 could also be in a number of different geometric configurations and could be made of a wide variety of materials within the scope of the preferred embodiments. A sleeve 130 is attached to the end of the rail 110, preferably via a weld 160. Sleeve 130 is preferably cylindrical in shape, with a hollow center. An end stop 140 passes through sleeve 130 and includes extending members 142 and 144 that extend downward on both sides of sleeve 130. In the preferred embodiments, end stop 140 has a circular cross-section that is smaller than the inside diameter of sleeve 130, and is made by inserting a cylindrical rod into sleeve 130, and bending the extending portions 142 and 144 parallel to each other and at right angles to the portion in the sleeve 130, resulting in the finished end stop 140 as shown in FIG. 1.

Figure 3:
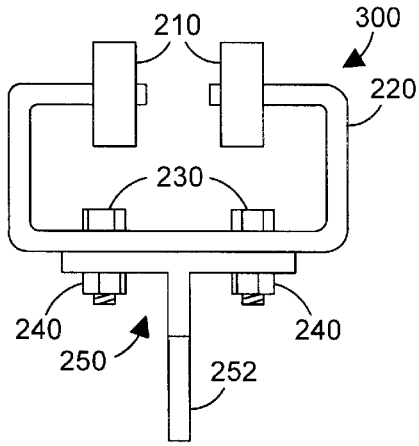
FIG. 3 is an end view of a trolley that may be used with the overhead rail system of FIGS. 1 and 2.

The rail of FIGS. 1 and 2 can accommodate a trolley that is used for attaching a safety line to personnel working in a multi-level warehouse. One suitable example of a trolley for the overhead rail system 100 of FIGS. 1 and 2 is shown as trolley 300 of FIG. 3. Trolley 300 includes a base portion 220 that has wheels 210 spaced apart so the wheels 210 will roll along the top surface of the lower flat member of rail 110, while passing on both sides of the vertical middle support member of rail 110. An extension portion 250 is preferably attached to the base portion 220, and includes a way for a person to hook a safety line to trolley 300. In the preferred embodiments, extension portion 250 is bolted to base portion 220 using several bolts 230 and corresponding nuts 240. In the preferred embodiments, extended portion 250 includes an eyelet 252 to which a person may attach a clip or hook that is attached to the end of a safety line that is coupled to the person. Eyelet 252 is shown in more detail in FIG. 4.

Figure 4:
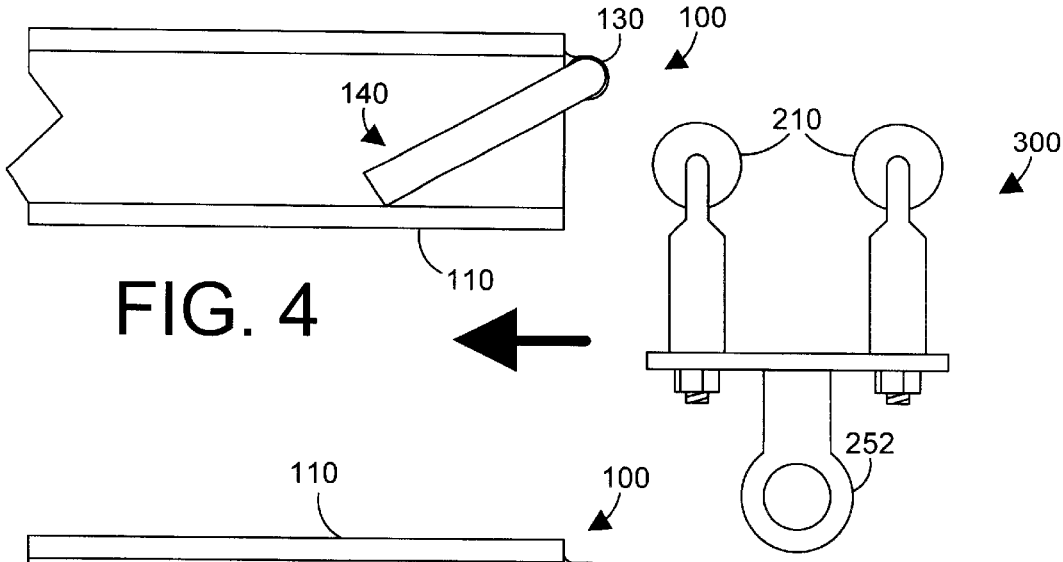
FIG. 4 is a side view of a trolley 300 and a rail 110 before the trolley 300 is placed on a rail 110 accordance with the preferred embodiments.
Figure 5:
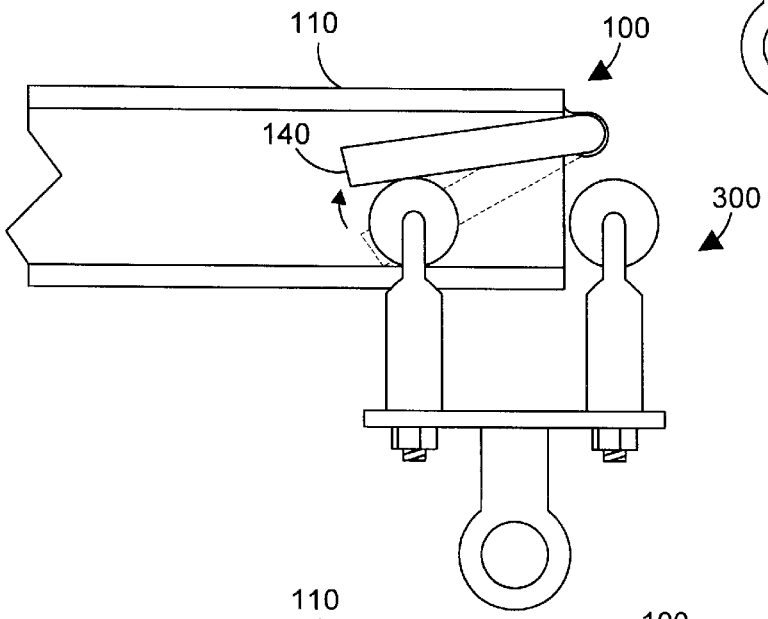
FIG. 5 is side view of the trolley and rail of FIG. 4 when the trolley is being rolled onto the rail.
Figure 6:
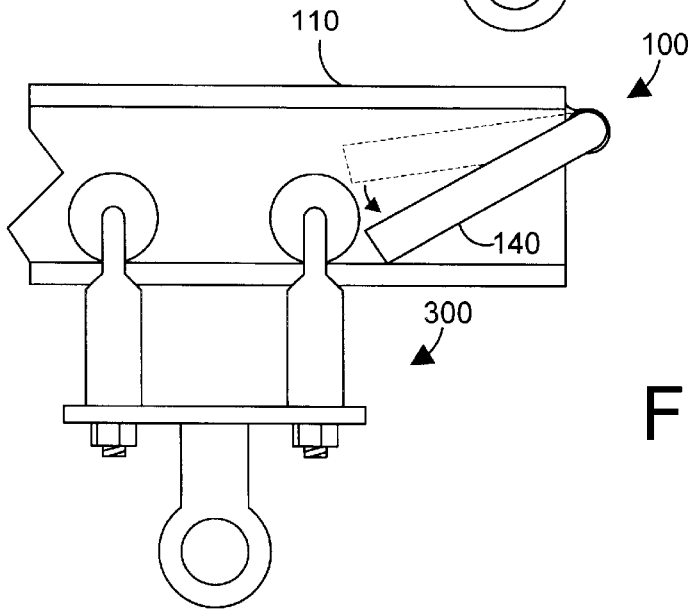
FIG. 6 is a side view of the trolley and rail of FIGS. 4 and 5 when the trolley has been rolled onto the rail.

The operation of the end stop 140 of the preferred embodiments is shown with reference to FIGS. 4–6. We assume that trolley 300 needs to be placed on rail 110 in the direction shown by the arrow in FIG. 4. The end stop 140 of the preferred embodiments, by passing through sleeve 130 and having extending portions 142 and 144, is normally in the position shown in FIG. 4 due to the force of gravity. The weight of the extending portions 142 and 144 cause the end stop pivot within sleeve 130 to naturally go to the position in FIG. 4. When trolley 300 needs to be put on rail 110, the wheels 210 of the trolley are pressed against the extending portions 142 and 144. This force causes the end stop 140 to pivot to an upper position, as shown in FIG. 5. This upper position of the end stop 140 allows the wheels 210 of the trolley 300 to pass underneath the end stop 140. As the trolley continues to be pushed onto rail 110, the second wheel will clear the end stop 140, which will cause the end stop to pivot back to its original position, as shown in FIG. 6. With the end stop in the position of FIG. 6, the trolley 300 is securely held on the rail, with no chance of the trolley 300 inadvertently coming off the end of rail 110.

Removing the trolley 300 from rail 110 is very easy, and can be accomplished without using any tools and without disassembling any portion of the overhead rail system 100. If the trolley 300 needs to be removed from the rail 110, a person can manually push one of the extending portions 142 and 144 upward, causing the end stop to pivot about the sleeve 130 and thereby creating space under the end stop that is sufficient for the trolley wheels to pass. In essence, removing the trolley 300 from rail 110 can be accomplished by reversing the process of placing the trolley 300 onto the rail 110. This can be illustrated by considering FIG. 6 first, with the trolley 300 on rail 110. The end stop 140 is pivoted into its upper position by a user pushing upward on an extending portions 142 or 144, and at the same time the trolley is moved towards the end of the rail, as shown in FIG. 5. The trolley 300 continues to move until it is off the rail 110, as shown in FIG. 4. In this manner a trolley 300 can be placed on rail 110 with one hand (by pushing the trolley onto the rail past the end stop 140), and can be easily removed using two hands (one to hold the end stop 140 in its upper position, and one to slide the trolley 300 past the end stop 140 past the end of rail 110).

The end stop of the preferred embodiments is a great improvement to an overhead rail system because trolleys can now be easily put on the rail and taken off the rail without requiring tools or disassembly. This is an especially significant advantage in refrigerated warehouses, where working with gloved hands make disassembly difficult to perform. When a trolley needs to be placed on the rail, it is simply pushed onto the rail past the end stop, which falls back to its lower position under the force of gravity once the trolley has cleared the end stop. When a trolley needs to be removed from the rail, the end stop is pushed up while the trolley is slid past the end stop. The end stop thus provides a convenient way to add and remove trolleys from an overhead rail system while providing a positive stop that will not allow a trolley to inadvertently come off the rail.

Figure 7:
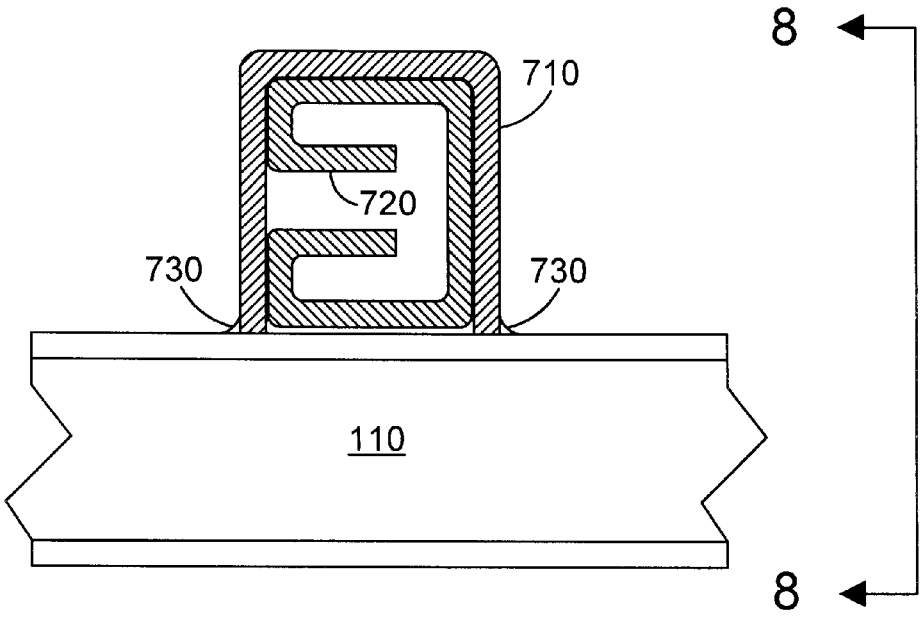
FIG. 7 is side view of a rail 110 and a cross-sectional view of a U-bracket 710 that is used to suspend the rail 110 from an existing structural member 720.
Figure 8:
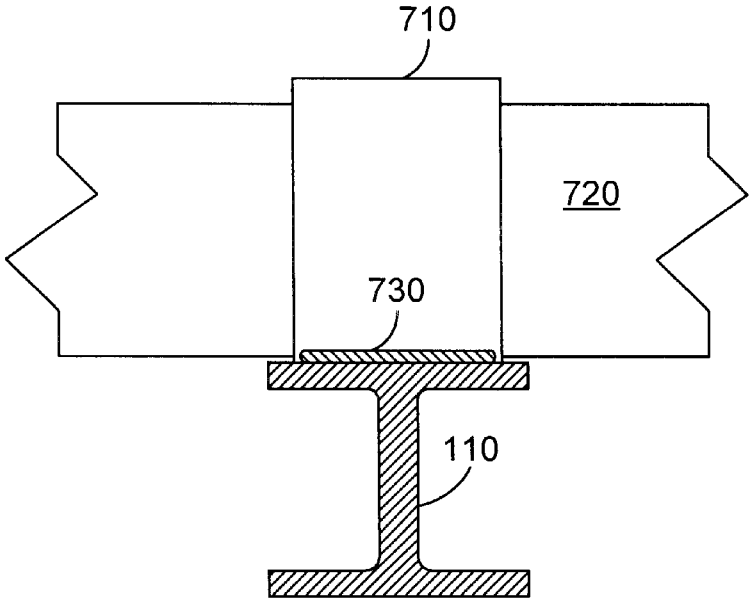
FIG. 8 is a cross-sectional view of the rail, U-bracket, and existing structural member shown in FIG. 7 along the lines 7—7.

Referring now to FIGS. 7 and 8, the overhead rail system 100 of the preferred embodiments also includes a U-bracket 710 that allows the rail 110 to be supported from an existing structural member 720. For example, we assume that a structural member 720 exists in a warehouse rail system, and that rail 110 needs to be run perpendicular to the structural member 720 and below the structural member 720. The U-bracket has inside dimensions that allow it to slip over a portion of the structural member 720, as shown in FIG. 7. Rail 110 can now be attached to U-bracket 710, preferably using welds 730. In this manner, an overhead rail system in accordance with the preferred embodiments allows a new rail 110 to be easily suspended from an existing structural member 720 using U-bracket 710.

While the invention has been particularly shown and described with reference to preferred embodiments thereof, it will be understood by those skilled in the art that various changes in form and details may be made therein without departing from the spirit and scope of the invention. For example, the specific example in the figures should not be construed as limiting. The preferred embodiments extend to any end stop mechanism that prevents a trolley from sliding off of the rail in one position, and that is easily moved out of the way with one hand to allow a trolley to be placed on the rail or removed from the rail without requiring tools or disassembly.

What is claimed is:

1. An overhead rail system comprising:

(A) a rail;

(B) an end stop coupled to an end face of the rail, the end stop comprising a member that is in a lower position due to the force of gravity to stop a trolley from coming off the rail, the end stop being deployed to an upper position to place a trolley on the rail or to remove a trolley from the rail, the end stop returning by the force of gravity to the lower position once the trolley is placed on the rail or removed from the rail.

2. The overhead rail system of claim 1 further comprising a sleeve coupled to the end face of the rail, through which the end stop is placed and about which the end stop pivots between the upper position and the lower position.

3. The overhead rail system of claim 2 wherein the sleeve is substantially cylindrical in shape and has a hollow interior, and wherein the end stop has a substantially circular cross-section with an exterior diameter that is less than the interior diameter of the sleeve, thereby allowing the end stop to rotate within the sleeve.

4. The overhead rail system of claim 1 further comprising a U-bracket having a substantially open interior portion for sliding over an existing structural member, the U-bracket being attached to the rail.

5. In an overhead rail system that includes a plurality of rails, an end stop comprising:

a substantially rigid member pivotally coupled to an end face of one of the plurality of rails, the substantially rigid member having a first pivot position that stops a trolley on the rail from sliding off the end of the rail, and having a second pivot position that allows a trolley to slide onto the rail or to slide off the end of the rail.

6. The end stop of claim 5 wherein the pivotal coupling between the end stop and the end of one of the plurality of rails comprises a sleeve coupled to the end face of the rail, through which the end stop is placed and about which the end stop pivots between the first pivot position and the second pivot position.

7. The end stop of claim 6 wherein the sleeve is substantially cylindrical in shape and has a hollow interior, and wherein the end stop has a substantially circular cross-section with an exterior diameter that is less than the interior diameter of the sleeve, thereby allowing the end stop to rotate within the sleeve, said rotation causing the pivoting between the first pivot position and the second pivot position.

8. A method for placing a trolley on an overhead rail that includes an end stop that is in a lower position due to the force of gravity, the method comprising the steps of:

pushing the trolley against the end stop, thereby causing the end stop to pivot to an upper position that creates space for the trolley to pass under the end stop;

continuing the pushing of the trolley onto the rail past the end stop, wherein the end stop returns to the lower position due to the force of gravity once the trolley is past the end stop.

9. The method of claim 8 further comprising the steps of:

pushing the end stop upward so the end stop pivots to an upper position that creates space for the trolley to pass under the end stop; and while holding the end stop in the upper position, pushing the trolley under the end stop and off the rail.

10. An overhead rail system comprising:

(A) an I-beam rail disposed in a substantially horizontal position with first and second recesses on first and second sides of the rail; and (B) an end stop coupled to an end face of the rail, the end stop comprising a member having at least a portion disposed within the first and second recesses of the rail, wherein the member is in a lower position due to the force of gravity to stop a trolley from coming off the rail, the end stop being deployed to an upper position to place a trolley on the rail or to remove a trolley from the rail, the end stop returning by the force of gravity to the lower position once the trolley is placed on the rail or removed from the rail.

11. The overhead rail system of claim 10 further comprising a sleeve coupled to the end face of the rail, through which the end stop is placed and about which the end stop pivots between the upper position and the lower position.

12. The overhead rail system of claim 11 wherein the sleeve is substantially cylindrical in shape and has a hollow interior, and wherein the end stop has a substantially circular cross-section with an exterior diameter that is less than the interior diameter of the sleeve, thereby allowing the end stop to rotate within the sleeve.

13. The overhead rail system of claim 10 further comprising a U-bracket having a substantially open interior portion for sliding over an existing structural member, the U-bracket being attached to the rail.

* * * * *